US006378452B1

(12) United States Patent
Bollerslev

(10) Patent No.: US 6,378,452 B1
(45) Date of Patent: Apr. 30, 2002

(54) PORTABLE BOAT STEP DEVICE

(76) Inventor: George T. Bollerslev, 18311 Ashworth Ave. North, Shoreline, WA (US) 98133

( * ) Notice: Subject to any disclaimer, the term of this patent is extended or adjusted under 35 U.S.C. 154(b) by 0 days.

(21) Appl. No.: 09/853,489

(22) Filed: May 11, 2001

(51) Int. Cl.[7] ..... B63B 17/00
(52) U.S. Cl. ..... 114/362
(58) Field of Search ..... 114/343, 362, 114/364; 182/90, 91, 92

(56) References Cited

U.S. PATENT DOCUMENTS

| | | | | |
|---|---|---|---|---|
| 2,975,858 A | | 3/1961 | Billingsley | |
| 3,587,123 A | * | 6/1971 | O'Boyle | 114/362 |
| 4,146,941 A | | 4/1979 | Haslam | |
| 4,611,552 A | * | 9/1986 | Koppelomaki | 114/343 |
| D296,887 S | | 7/1988 | Walling et al. | |
| 4,823,910 A | * | 4/1989 | Day | 114/362 |
| 5,152,245 A | | 10/1992 | Olsen | |
| 5,222,456 A | | 6/1993 | Friedrich | |
| 5,540,178 A | | 7/1996 | Damron | |
| 6,119,615 A | * | 9/2000 | Porat | 114/85 |

FOREIGN PATENT DOCUMENTS

| | | | |
|---|---|---|---|
| DE | 26176 | * 11/1963 | 114/362 |

* cited by examiner

*Primary Examiner*—S. Joseph Morano
*Assistant Examiner*—Andrew D. Wright

(57) ABSTRACT

A portable boat step device for allowing the user to more easily scale the bow as one enters the boat from the bow. The portable boat step device includes a planar step member having a back end and a front end and being adapted to suspend from a side of a boat; and also includes a flexible line being attached at the back end of the planar step member and being adapted to loop about a mooring cleat of the boat; and further includes a fastening member being attached to the front end of the planar step member and being adapted to removably attach to an eyelet which is securely attached to a bow of the boat.

7 Claims, 2 Drawing Sheets

PORTABLE BOAT STEP DEVICE

BACKGROUND OF THE INVENTION

1. Field of the Invention

The present invention relates to suspendable boat steps and more particularly pertains to a new portable boat step device for allowing the user to more easily scale the bow as one enters the boat from the bow.

2. Description of the Prior Art

The use of suspendable boat steps is known in the prior art. More specifically, suspendable boat steps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,146,941; 5,222,456; 2,975,858; 5,152,245; 5,540,178; and U.S. Pat. No. Des. 296,887.

While these devices fulfill their respective, particular objectives and requirements, the aforementioned patents do not disclose a new portable boat step device. The inventive device includes a planar step member having a back end and a front end and being adapted to suspend from a side of a boat; and also includes a flexible line being attached at the back end of the planar step member and being adapted to loop about a mooring cleat of the boat; and further includes a fastening member being attached to the front end of the planar step member and being adapted to removably attach to an eyelet which is securely attached to a bow of the boat.

In these respects, the portable boat step device according to the present invention substantially departs from the conventional concepts and designs of the prior art, and in so doing provides an apparatus primarily developed for the purpose of allowing the user to more easily scale the bow as one enters the boat from the bow.

SUMMARY OF THE INVENTION

In view of the foregoing disadvantages inherent in the known types of suspendable boat steps now present in the prior art, the present invention provides a new portable boat step device construction wherein the same can be utilized for allowing the user to more easily scale the bow as one enters the boat from the bow.

The general purpose of the present invention, which will be described subsequently in greater detail, is to provide a new portable boat step device which has many of the advantages of the suspendable boat steps mentioned heretofore and many novel features that result in a new portable boat step device which is not anticipated, rendered obvious, suggested, or even implied by any of the prior art suspendable boat steps, either alone or in any combination thereof.

To attain this, the present invention generally comprises a planar step member having a back end and a front end and being adapted to suspend from a side of a boat; and also includes a flexible line being attached at the back end of the planar step member and being adapted to loop about a mooring cleat of the boat; and further includes a fastening member being attached to the front end of the planar step member and being adapted to removably attach to an eyelet which is securely attached to a bow of the boat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable boat step device which has many of the advantages of the suspendable boat steps mentioned heretofore and many novel features that result in a new portable boat step device which is not anticipated, rendered obvious, suggested, or even implied by any of the prior art suspendable boat steps, either alone or in any combination thereof.

It is another object of the present invention to provide a new portable boat step device which may be easily and efficiently manufactured and marketed.

It is a further object of the present invention to provide a new portable boat step device which is of a durable and reliable construction.

An even further object of the present invention is to provide a new portable boat step device which is susceptible of a low cost of manufacture with regard to both materials and labor, and which accordingly is then susceptible of low prices of sale to the consuming public, thereby making such portable boat step device economically available to the buying public.

Still yet another object of the present invention is to provide a new portable boat step device which provides in the apparatuses and methods of the prior art some of the advantages thereof, while simultaneously overcoming some of the disadvantages normally associated therewith.

Still another object of the present invention is to provide a new portable boat step device for allowing the user to more easily scale the bow as one enters the boat from the bow.

Yet another object of the present invention is to provide a new portable boat step device which includes a planar step member having a back end and a front end and being adapted to suspend from a side of a boat; and also includes a flexible line being attached at the back end of the planar step member and being adapted to loop about a mooring cleat of the boat; and further includes a fastening member being attached to the front end of the planar step member and being adapted to removably attach to an eyelet which is securely attached to a bow of the boat.

Still yet another object of the present invention is to provide a new portable boat step device that is easy and convenient to set up and then remove when not needed.

Even still another object of the present invention is to provide a new portable boat step device that prevents the user from falling and hurting oneself as the user enters the boat from the bow since the boat is beached bow first.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
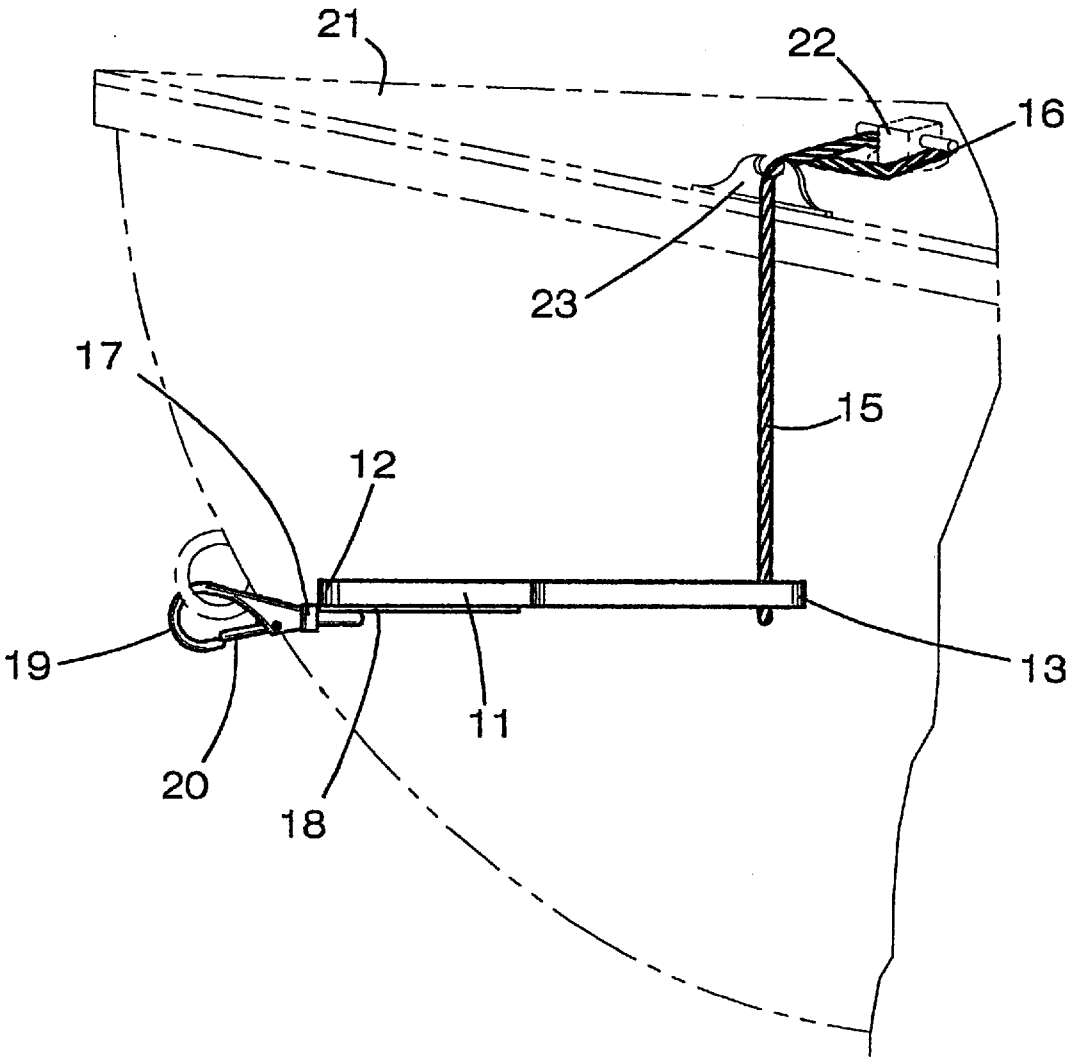
FIG. 1 is a perspective view of a new portable boat step device according to the present invention and shown in use.
Figure 2:
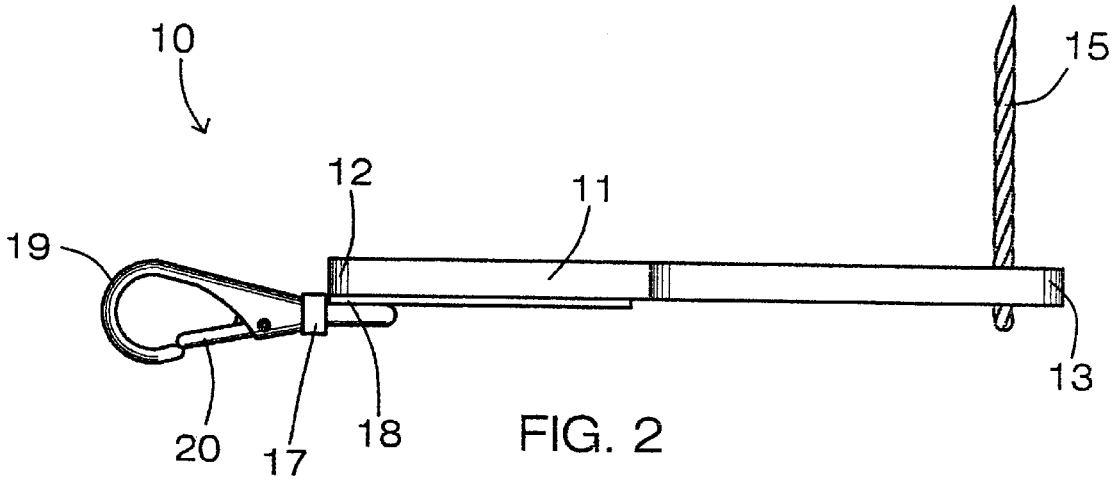
FIG. 2 is a partial side elevational view of the present invention.
Figure 3:
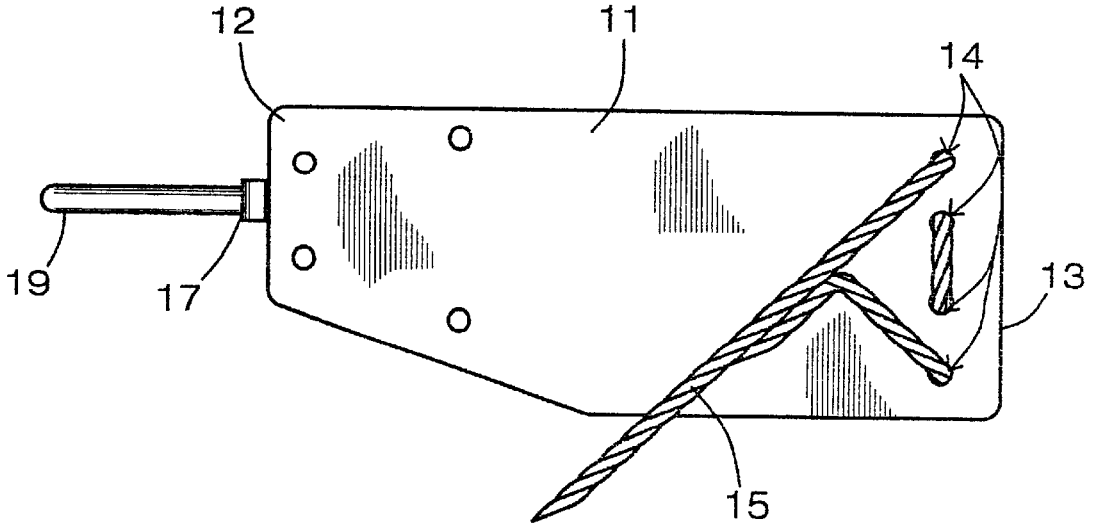
FIG. 3 is a top plan view of the present invention.

With reference now to the drawings, and in particular to FIGS. 1 through 3 thereof, a new portable boat step device embodying the principles and concepts of the present invention and generally designated by the reference numeral 10 will be described.

As best illustrated in FIGS. 1 through 3, the portable boat step device 10 generally comprises a planar step member 11 having a back end 13 and a front end 13 and being adapted to suspend from a side of a boat 21. The planar step member 11 includes a plurality of holes 14 being spaced apart and being align along the back end thereof and being disposed through the planar step member 11.

A flexible line 15 is attached at the back end 13 of the planar step member 11 is being adapted to loop about a mooring cleat 22 of the boat 21. The flexible line 15 is weaved through the holes 14 in the planar step member 11 and has a portion which is movably supported upon a bow chalk 23 having a slot therein, and also has an end portion 16 which is looped about the mooring cleat 22 of the boat 21 for securing and suspending the step member 11 to the boat 21. A fastening member 17 is securely and conventionally attached and fastened to the front end 12 of the planar step member 11 and is adapted to removably attach to an eyelet 24 which is securely attached to a bow of the boat 21. The fastening member 17 includes a handle 18 being securely attached and conventionally fastened to a bottom of the step member 11, and also includes a hook member 19 being integrally attached to the handle 18 and extending outwardly from the front end 12 of the step member 11, and further includes a lever 20 being hingedly attached to the hook member 19 and biasedly closing the hook member 19. The hook member 19 is adapted to hook about the eyelet 24 with the lever 20 preventing the hook member 19 from falling off the eyelet 22.

In use, the user loops the end portion of the flexible line about the mooring cleat 22 to suspend the step member along the bow of the boat 21, and the user fastens the fastening member 17 to the eyelet 24 being mounted to the bow of the boat 21 with the step member 11 being suspended along the bow of the boat 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable boat step device comprising:

a planar step member having a back end and a front end and being adapted to suspend from a side of a boat;

a flexible line being attached at said back end of said planar step member and being adapted to loop about a mooring cleat of the boat; and a fastening member being attached to said front end of said planar step member and being adapted to removably attach to an eyelet which is securely attached to a bow of the boat;

wherein said fastening member includes a hook member mounted on and extending outwardly from said front end of said step member, a lever hingedly attached to said hook member for biasedly closing an opening in said hook member, said hook member being adapted to hook about the eyelet with said lever preventing said hook member from falling off the eyelet.

2. A portable boat step device as described in claim 1, wherein said planar step member includes a plurality of holes being spaced apart and being aligned along said back end thereof and being disposed through said planar step member.

3. A portable boat step device of claim 1 wherein:

said planar step member includes a plurality of holes being spaced apart and is aligned along said back end thereof and being disposed through said planar step member;

said flexible line is weaved through said holes in said planar step member and having a portion which is movably supported upon a bow chalk having a slot therein, and also having an end portion which is looped about the mooring cleat of the boat for securing and suspending said step member to the boat; and said fastening member includes a handle being securely attached to a bottom of said step member, and also including a hook member being integrally attached to said handle and extending outwardly from said front end of said step member, and further including a lever being hingedly attached to said hook member and biasedly closing said hook member, said hook member being adapted to hook about the eyelet with said lever preventing said hook member from falling off the eyelet.

4. A portable boat step device comprising:

a planar step member having a back end and a front end and being adapted to suspend from a side of a boat;

a flexible line being attached at said back end of said planar step member and being adapted to loop about a mooring cleat of the boat; and a fastening member being attached to said front end of said planar step member and being adapted to removably attach to an eyelet which is securely attached to a bow of the boat;

wherein said fastening member includes a handle being attached to a bottom of said step member, and also includes a hook member being integrally attached to said handle and extending outwardly from said front end of said step member, and further includes a lever being hingedly attached to said hook member and biasedly closing said hook member, said hook member being adapted to hook about the eyelet with said lever preventing said hook member from falling off the eyelet.

5. A portable boat step device as described in claim 4, wherein said planar step member includes a plurality of holes being spaced apart an is aligned along back end thereof and being disposed through said planer step member.

6. A portable boat step device as described in claim 5, wherein said flexible line is weaved through said holes in said planar step member and has a portion which is movably supported upon a bow chalk having a slot therein, and also has an end portion which is looped about the mooring cleat of the boat for securing and suspending said step member to the boat.

7. A portable boat step device comprising:

a planar step member having a back end and a front end and being adapted to suspend from a side of a boat;

a flexible line being attached at said back end of said planar step member and being adapted to loop about a mooring cleat of the boat; and a fastening member being attached to said front end of said planar step member and being adapted to removably attach to an eyelet which is securely attached to a bow of the boat;

wherein said planar step member includes a plurality of holes being spaced apart and being aligned along said back end thereof and being disposed through said planar step member;

wherein said flexible line is weaved through said holes in said planar step member and has a portion which is movably supported upon a bow chalk having a slot therein, and also has an end portion which is looped about the mooring cleat of the boat for securing and suspending said step member to the boat.

* * * * *